United States Patent [19]

Esper et al.

[11] Patent Number: 4,533,392

[45] Date of Patent: Aug. 6, 1985

[54] HIGH STRENGTH SINTERED ALLOY

[75] Inventors: Friedrich J. Esper, Leonberg; Robert Zeller, Stuttgart, both of Fed. Rep. of Germany

[73] Assignee: Robert Bosch GmbH, Stuttgart, Fed. Rep. of Germany

[21] Appl. No.: 878,480

[22] Filed: Feb. 16, 1978

[30] Foreign Application Priority Data

Mar. 2, 1977 [DE] Fed. Rep. of Germany ..... 2708916

[51] Int. Cl.[3] ..... B22F 1/00; C22C 38/02

[52] U.S. Cl. ..... 75/230; 75/123 D; 75/123 L; 419/10

[58] Field of Search ..... 75/123 L, 123 D, 230, 75/200.2; 419/10

[56] References Cited

U.S. PATENT DOCUMENTS 1,352,534 9/1920 Russell ..... 75/123 L
2,179,695 11/1939 Jominy ..... 75/123 D
2,213,523 9/1940 Jones et al. ..... 75/200.2
3,689,257 9/1972 Oda et al. ..... 75/200.2
4,023,990 5/1977 Lex ..... 75/123 L

FOREIGN PATENT DOCUMENTS 431975 7/1935 United Kingdom ..... 75/123 D

*Primary Examiner*—Teddy S. Gron
*Assistant Examiner*—Anne Brookes
*Attorney, Agent, or Firm*—Frishauf, Holtz, Goodman & Woodward

[57] ABSTRACT

High strength ductile sintered iron alloy composition containing silicon and phosphorus with a total alloy content below 4% having a yield point above 400 $N/mm^2$ and an impact strength of more than 40 $J/cm^2$. The alloys contain between about 0.5 and 3% by weight silicon, and between about 0.2 and 0.7% phosphorus, with the balance being iron. These alloy compositions are made by sintering iron, iron-silicon and iron-phosphorus powders at temperatures between about 1050° and 1200° C.

2 Claims, No Drawings

HIGH STRENGTH SINTERED ALLOY

BACKGROUND OF THE INVENTION

Sintered silicon-containing iron alloys are known. These alloys exhibit a yield strength of more than 400 $N/mm^2$ only when they have a silicon content of more than 6% and when sintered for five hours at a temperature between 1225° and 1275° C.

It is also known that the addition of iron-phosphorus powders to iron powders causes a reduction in the time of sintering when compared to the sintering of iron powder without the iron phosphorus additive. When using the iron-phosphorus powders admixed with the iron powders, a liquid phase can be formed at the sintering temperature resulting in an increased density, which increase of density may be correlated to increased amounts of the iron-phosphorus additive. However, the addition of more than 0.8% of phosphorus results in structural components formed from such phosphorus-containing sintered iron alloys which have increased hardness and brittleness and lowered workability.

THE INVENTION

The invention provides high strength silicon and phosphorus-containing sintered iron alloy compositions consisting essentially of sintered-together mixed powders of iron, iron-silicon alloy and iron-phosphorus alloy, with iron powder predominant and the other components in such proportion that the total content of silicon and phosphorus in the composition is less than 4% by weight and the phosphorus content is less than the silicon content and between 0.2% and 0.7% by weight silicon and phosphorus. More particularly these alloys contain between about 1.5% and about 2% silicon, and about 0.45% phosphorus. These alloy compositions are characterized by a yield point of more than 400 $N/mm^2$ and an impact strength of more than 40 $J/cm^2$. These alloy compositions may be formed by sintering at temperatures between about 1050° and 1200° C., and preferably between about 1100° C. and 1150° C. This relatively low sintering temperature is economic in that there is an energy saving when compared with higher temperature processes. It also has the advantage that the service life of the structural and other elements of the sintering furnace are substantially lengthened. As a consequence of the foregoing, the present invention provides economic sintered alloys having a relatively low manufacturing cost. These economic silicon-phosphorus-containing sintered iron alloys of the present invention have the further advantage of outstanding mechanical properties achieved by a very economical manufacturing process.

The sintered alloy compositions or compacts of the present invention are preferably manufactured by admixing powdered iron with a powdered pre-alloyed iron-silicon (preferably containing more than 40% silicon by weight) and a pre-alloyed iron-phosphorus (preferably containing more than 10% phosphorus by weight). The powders are mixed, preferably with a small amount of a lubricant, e.g., zinc stearate. The powder mixture is then compacted (pressed) in a die under a pressure of 600 $MN/m^2$. The pressed green compact is then sintered in a furnace for 60 minutes at a temperature of between about 1100° and 1150° C., preferably in a hydrogen atmosphere and then cooled to room temperature, whereby the process of cooling is not critical.

Four test specimens in accordance with ASTM standards were prepared as described above. Their compositions are set forth in the following table. The resultant physical properties for alloys produced at 1100° and 1150° C., respectively, are set forth in the following table:

TABLE

| Si—P IRON ALLOY | | SINTERING TEMPERATURE | TENSILE STRENGTH | YIELD POINT | IMPACT STRENGTH |
|---|---|---|---|---|---|
| P (%) | Si (%) | (°C.) | ($N/mm^2$) | ($N/mm^2$) | ($J/cm^2$) |
| 0.45 | 1.5 | 1150 | 530 | 410 | 70 |
| 0.45 | 2.0 | 1150 | 545 | 430 | 60 |
| 0.6 | 1.0 | 1100 | 505 | 405 | 48 |
| | | 1150 | 540 | 415 | 68 |
| 0.6 | 1.5 | 1150 | 570 | 440 | 52 |

We claim:

1. A high strength ductile sintered iron alloy composition consisting essentially of sintered-together mixed powders or iron, iron-silicon alloy and iron-phosphorus alloy, with iron powder in predominant proportion therein and the mixture such that the silicon content of the sintered composition is about 1.5% by weight and the phosphorus content of the sintered composition is about 0.45%, with the balance being essentially iron, and the composition having a yield point above 400 $N/mm^2$ and an impact strength of more than 40 $J/cm^2$.

2. A high strength ductile sintered iron alloy composition consisting essentially of sintered-together mixed powders or iron, iron-silicon alloy and iron-phosphorus alloy, with iron powder in predominant proportion therein and the mixture such that the silicon content of the sintered composition is between about 2% by weight and the phosphorus content of the sintered composition is between about 0.45%, with the balance being essentially iron and the composition having a yield point above 400 $N/mm^2$ and an impact strength of more than 40 $J/cm^2$.

* * * * *